United States Patent [19]

Hart

[11] 4,194,298

[45] Mar. 25, 1980

[54] AIR DRYING OF REFRACTORY HARDWOODS

[75] Inventor: C. Arthur Hart, Raleigh, N.C.

[73] Assignee: Research Triangle Institute, N.C.

[21] Appl. No.: 911,753

[22] Filed: Jun. 2, 1978

[51] Int. Cl.[2] ..... F26B 19/00

[52] U.S. Cl. ..... 34/94; 34/9.5; 34/95

[58] Field of Search ..... 34/6, 9.5, 16.5, 94, 34/95

[56] References Cited

U.S. PATENT DOCUMENTS 2,679,111 5/1954 Leischner ..... 36/6

*Primary Examiner*—John J. Camby

*Attorney, Agent, or Firm*—Cushman, Darby & Cushman

[57] ABSTRACT

A method of air drying of refractory hardwoods which reduces the surface checking and splitting of such wood by utilizing articles consisting of hygroscopic sheets and spacing means which are, in turn, alternately layered with boards of lumber.

4 Claims, 4 Drawing Figures

AIR DRYING OF REFRACTORY HARDWOODS

BACKGROUND AND SUMMARY OF THE INVENTION

After cutting timber into boards, the boards must be reduced in moisture content before they can be used commercially. During this period of drying, the surfaces of the boards must, of course, dry and therefore shrink before the interior of the board is dried. Unless the surface drying is carefully controlled, the resultant shrinkage of the surface can result in splitting or checking of the surface which will severely reduce the value of the lumber. Control of the moisture content of the surface is normally accomplished by either controlling the humidity of the air as in kiln drying, or by air drying in the outdoors during suitable seasons. Also, as disclosed by Leischner in U.S. Pat. No. 2,679,111, the control of surface moisture content can be accomplished by placing a thin barrier or sheet of suitable material between the wood surface and the circulating air in order to maintain a layer of moisture and thus protect the wood surface from the drying air.

Normally, lumber is air dried in stacks with each single layer or course of boards being separated from the adjacent layers by spacers called stickers which allow air circulation across the surfaces of the boards. The stickers, which are wood, are usually about 0.75 inches thick by 1.25 to 1.50 inches wide, are laid at right angles to the boards and are of a length that is determined by the width of the layer of boards. Except where they are in contact with the stickers, the surfaces of the boards are exposed to the drying air and may quickly dry to very near the equilibrium moisture content (hereinafter sometimes referred to as EMC) of the air. In kiln drying, temperature and humidity are automatically controlled so that the EMC of the air in the kiln is initially at a high level. The EMC is then gradually reduced as the drying process proceeds which allows for the gradual shrinkage of the surfaces of the boards and thereby avoids the surface checking that results if the surfaces are dried too quickly.

Wood which is to be used in the manufacturing of furniture and for decorative purposes must be free of surface checks and other drying defects. Therefore, these species of wood, particularly those which are commonly referred to as "refractory hardwoods" because of their tendency to check easily, must be dried very slowly and carefully in order to maintain their value. Because kiln drying requires vast expenditures of energy, air drying in stacks utilizing stickers is often used until the wood has dried to the point where it can be safely put in the kiln and quickly brought to the final desired level of dryness.

However, said air drying leaves the wood at the mercy of the weather. Refractory woods, because of their slow rate of moisture diffusion, are relatively slow in drying. Thus, the moisture from the interior of the board is slow in reaching the surfaces of the board. As a result, the surfaces quickly approach the EMC level of the drying air, and a period of severe drying weather can result in disastrous losses of refractory woods in a single drying yard. To avoid the possibility of a sustained period of severe drying weather, refractory woods are often put in the drying yard in late fall or winter. This allows for substantial drying to occur prior to the severe drying weather of summer.

Leischner in U.S. Pat. No. 2,679,111 discloses another method of drying lumber to avoid checking and splitting of the surface. Leischner places porous material with a moisture permeability less than the lumber around the piece of lumber to be dried. This provides for control of the moisture content at the surfaces of the lumber with the concurrent control of shrinkage. But in order to accomplish this method of controlled drying Leischner provides space for the circulating air and support for the entire structure by using a heavy bulky metal apparatus consisting of two perforated metal sheets which are kept spaced apart by a third corrugated sheet welded to the two perforated sheets. The purpose of this structure is to provide both support for the porous covering sheets and space between the covering sheets for circulation of the drying air. Because of this structure, which is inherently unsuitable and impractical for use in drying yards, the apparatus disclosed by Leischner is not used by drying yards. Instead, as discussed above, lumber is air dried in stacks with means for spacing provided to allow circulation of air between the layers but continually present is the danger of checking and splitting which often results from the uncontrolled air drying of wood.

In order to overcome all of these problems, an article has been developed to facilitate the air drying of refractory hardwood with minimum drying defects even in severe drying weather. Hygroscopic sheets, herein termed either face sheets or facing sheets, are glued, nailed, stapled, or otherwise attached to spacing means to form an integral article. These articles hereinafter sometimes referred to as pallets are then alternately layered with the boards of lumber forming stacks. With the lumber alternately layered in this manner with the pallets, the face sheets separate the board surfaces from the drying air which instead of contacting the surfaces of the boards directly now circulates between the face sheets. The face sheets may be of any suitable hygroscopic material. One readily available material is 3-ply plywood. The moisture permeability of the face sheets may be predetermined through selection of the species and thickness of the wood veneers and the nature of the glue used to make the plywood face sheets. Thus the pallet can be engineered to provide the degree of protection deemed necessary for both the particular wood species that is to be dried and the severity of drying weather that is expected in the given locality.

BRIEF DESCRIPTION OF THE DRAWINGS

By way of example the invention will be illustrated by reference to drawings which are directed to the structure of the article of the present invention.

DESCRIPTION OF THE INVENTION

The design of the pallet has several inherent advantages. First, it is able to provide the necessary protection from any specified severity of drying conditions.

Figure 1:
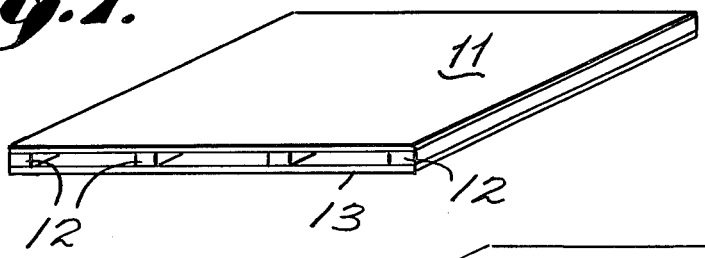
FIG. 1 is a diagrammatic perspective view of a pallet.
Figure 3:
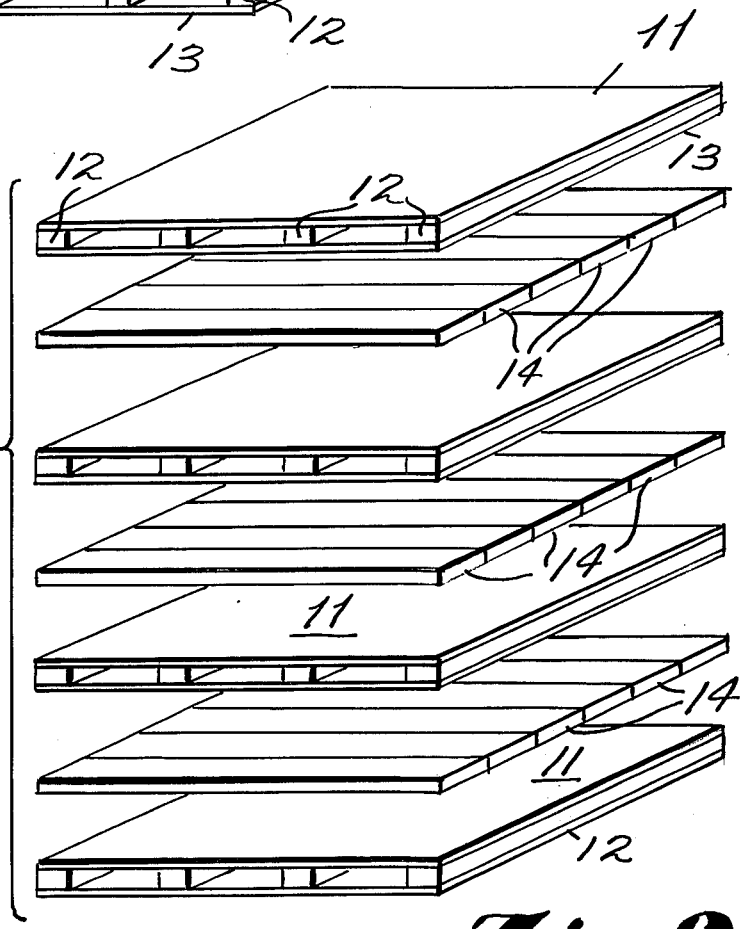
FIG. 3 is a diagrammatic perspective exploded view of a stack formed by alternately layering pallets with single layers of boards.
Figure 2:
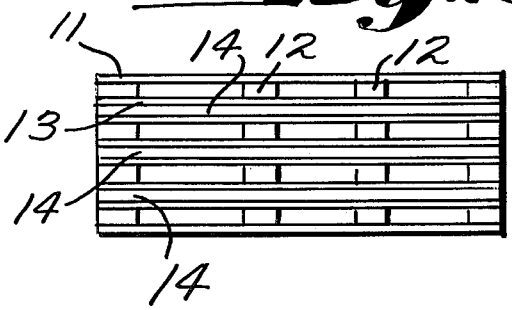
FIG. 2 is a diagrammatic front view of a stack formed by alternately layering pallets with single layers of boards.

Second, it is durable enough and sufficiently rugged to withstand the rigors of weather along with the stresses and strains imposed during drying as well as those imposed during the stacking and unstacking operation. Third, the total pallet thickness is small allowing the stacking of the optimum amount of lumber in any given space. Fourth, the pallet is lightweight which means the amount of energy needed to stack and unstack is kept to a minimum. As shown in FIG. 1, the hygroscopic face sheets 11 and 13 are attached to the spacing means 12 forming a pallet-like article. This article with its inherent structural strength serves the dual function of providing hygroscopic surfaces in contact with the surfaces 14 of FIGS. 2 and 3 of the boards of lumber to be dried and of providing the structural support which allows the stack of alternating layers of boards of lumber and pallets to be formed. The stack is not only self-supporting, but it also prevents warping of the boards during the course of the drying operation.

In order to facilitate handling in the drying yard, the face sheets are permanently attached to the spacing means. The pallet design is not limited to any particular size of spacing means or number of spacing means provided between the face sheets. Variations in size and spacing of the spacing means can be made to maximize the structural strength of the pallet. The pallets can be any convenient dimension for handling. The pallets can be simply butted against one another in a given course or layer to provide the necessary surface area.

The face sheets may be 3-ply plywood, and can be attached by glue to the spacing means which may be wood stickers. The wood stickers may be of any size but are preferably about ½ inch thick and spaced at intervals of about 6 inches. Since standard plywood hot presses produced a 4 foot×8 foot panel and these standard size panels are suitable for use as face sheets, pallets constructed of these standard sheets will be four feet perpendicular to the sticker and as wide as desired, and up to eight feet parallel to the stickers. The four foot sections can be butted up against each other in sufficient number to equal or exceed the length of the lumber to be dried. The sections could also be clamped together to form a single unit to facilitate moving.

Because lumber is dried in even foot lengths, a two-foot section in combination with four-foot sections may be preferable for drying stack lengths which are not multiples of four. Conversely, it may be desirable at times to use 4-foot sections with a 1-foot overlap at each end of the stack. Lumber may also be box stacked to 4-foot multiples.

Veneer face sheets may be used instead of plywood. A single veneer sheet glued to very closely spaced stickers provides some advantages for lumber in the range of about 1.0 inch to about 1.5 inches thick.

A 2-ply plywood face sheet may also be used but this would require closely spaced stickers although the face sheet and stickers could be glued simultaneously.

As described above, the preferable face sheet is 3-ply plywood glued to wood stickers with exterior glue in all cases.

A pallet constructed of 3-ply plywood which is subsequently glued to wood stickers is the preferred type of pallet construction for drying lumber with thicknesses greater than about 2.0 inches. The spacing of the wood stickers while preferably about 6 inches can range up to about 1 foot.

The spacer means are preferably wood stickers, and conventional wood stickers with the dimensions as described above may be used in the pallets. Conventional stickers are generally about ¾ inches thick but there can be wide variations in both thickness and width. When used in conventional air drying techniques, the stickers are usually larger than needed for adequate air circulation in order to decrease breakage of the stickers and to prevent compression failure of either the stickers or boards of lumber from the weight of the load.

Utilization of the pallets permits the use of thinner stickers, for example, ⅝ of an inch thick, because the face sheets absorb the bending forces.

The determination of the required thickness of the face sheets in order to have the proper degree of moisture protection is a four-step process. Initially, the critical point in the drying schedule must be determined. If adequate protection exists at this point, adequate protection is assured at all other times. Secondly, the most severe climatic conditions for which protection is required must be determined. Thirdly, the required identical facing thickness if the facing sheet is of the same wood must be calculated. Fourthly, an estimation of the equivalent thickness of other facing sheet materials to provide the same degree of protection, as calculated in step three above, must be made.

For the air drying of native refractory hardwoods in most of the furniture manufacturing areas in the United States, applicant has discovered that a simplified rule of thumb for calculating the identical facing sheet thickness, $X_I$, is that $X_I$ should be between about 6.5% and about 12.5% of the thickness of the board to be dried with a range from about 8% to about 11% of the board thickness for most applications.

The rule of thumb of about 8 to about 11% is applicable for an identical facing sheet thickness to provide a board surface moisture content of between about 19% to about 17.5% when the board has dried to about 40% average moisture content and the ambient equilibrium moisture content (EMC) of the drying atmosphere is between about 6 to about 8%. All moisture contents are weight of water/weight of oven dry wood, multiplied by 100%.

A more specific calculation of thickness can be made by following the aforesaid four steps.

The critical point in the drying schedule can be obtained by the dry kiln schedules presented in the Dry Kiln Operator's Manual, i.e., Rasmussen, E. F., 1961, Dry Kiln Operator's Manual. Agriculture Hardbook No. 188, Forest Products Laboratory, Forest Service, U.S. Department of Agriculture. From the schedule, the permissable levels of the board surface moisture content as the board average moisture content is reduced can be determined. The drying conditions are changed in steps as drying progresses. The end of the first step may, for practical purposes, be considered as the critical point for which the pallet must be designed so that the surface moisture content of the board will not be less with the pallet protected wood than is recommended for the kiln drying wood.

For example, for 2-inch thick white oak, this manual recommends schedules T3 and C1, or 110° F. dry bulb and a 3° F. wet bulb depression until the average moisture content falls to 40%. The estimated moisture content for these temperature conditions is 19%, so the critical point is a 19% board surface moisture content at 40% average moisture content. However, at 40% average moisture content, the schedule calls for the wet bulb depression to be increased to 4° F., which translates to 17.5% expected moisture content, so 19% to 17.5% may be taken as a permissible range.

To determine the most severe climatic conditions, the records of the weather bureau can be consulted to learn the expected climatic conditions in the area. Once this information is obtained, the severity of drying conditions to be protected against is determined. If it is decided to be conservative and a 0% relative humidity is decided to be the condition to be protected against, the face sheet needed will necessarily be thicker than at a higher relative humidity. This will result in a greater investment cost and also in a longer drying time.

For example, a minimum relative humidity of 30%, resulting in an expected moisture content of about 6% was determined to provide the maximum desirable protection in and around the Raleigh, N.C. area. However, a relative humidity low of around 45% during the drier months is much more typical, so a moisture content of about 8% was used as being more practical and economical. This resulted in an EMC of about 6 to about 8% as the probable range for which protection should be provided.

The required identical facing thickness is determined by using a sine moisture profile. If the sine curve is derived in terms of:

$M_B$=Board average moisture content, $M_X$=Board surface moisture content, which is also the moisture content at the interface between the board and the facing, $M_E$=Equilibrium moisture content for the most severe ambient drying atmosphere, $X_I$=Identical facing sheet thickness, W=Thickness of the refractory hardwood being dried, and R=Facing thickness/board thickness=$X_I/W$. Then the following equation is obtained:

$$\frac{\bar{M}_B + M_E}{M_X - M_E}\left(\frac{\pi}{2}\right) = (2R + 1)\,\mathrm{Cot}[\pi R/(2R + 1)]$$

This equation is simply a sine moisture profile from the outer surface of the facing to the center of the board and assumes the facing is made of the same material as the board to be dried.

Once R is determined, the thickness of the facing sheet, which is referred to herein as the identical facing sheet thickness, is obtained from the equation $$X_I = RW$$

By sequential trials, the value of R to satisfy the more stringent drying conditions of $M_B$=40, $M_X$=19 and $M_E$=6 can be determined. This gives R=0.1133 so the calculated identical facing thickness for 2-inch white oak air dried near Raleigh, N.C., is 11.3% of the board thickness or 0.226 inches. Thus, ¼ inch commercial plywood would be suitable if its diffusion coefficient were equal to that of the oak.

For less stringent values, i.e., $M_X$=17.5 and $M_E$=8, the R value is 0.0796 or essentially 8% of the board thickness. Thus, the optimum identical facing thickness should fall in the range of about 8% to about 11% of the board thickness for white oak which is within the rule of thumb discussed above.

In order to estimate the actual or equivalent thickness needed for another material, it is necessary to obtain estimates of the moisture diffusion coefficients or estimates of their ratio. Plywood is generally made from softwood species which tend to exhibit relatively high diffusion coefficients while the refractory hardwoods tend to have low diffusion coefficients. However, the glueline in the plywood may add to its resistance to moisture flow to such an extent that the overall coefficient of diffusion for the plywood face sheet may be very close to that of the refractory hardwood being dried.

The actual or as referred to herein the equivalent facing sheet thickness, $X_E$, of a material having a moisture diffusion coefficient, $D_E$, which is different from the moisture diffusion coefficient, $D_I$, of the boards to be dried is calculated by the equation $$X_E/X_I = D_E/D_I \text{ or}$$

$$X_E = X_I(D_E/D_I)$$

where $X_I$ is the identical facing sheet thickness calculated by the above equations and where the dimensions of D are in square centimeters per second or equivalent.

Figure 4:
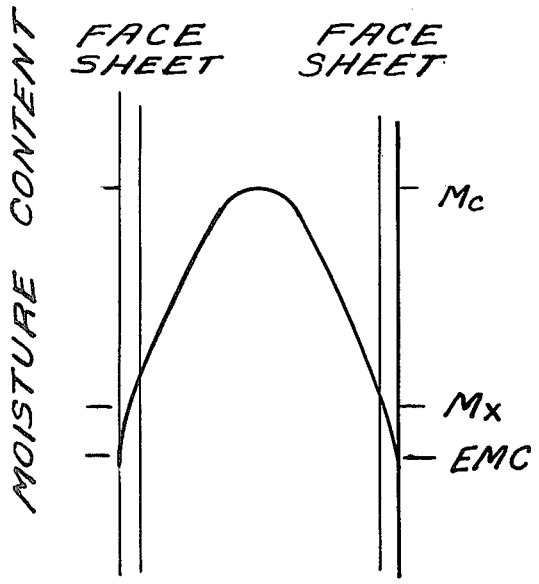
FIG. 4 is a sine moisture curve showing the extent to which $\frac{1}{8}$ inch face sheets can keep the board surface moisture content (Mx) well above the ambient equilibrium moisture control (EMC).

An indication of the degree of protection from severe drying weather that can be expected using said stacks is obtainable from the sine moisture profile. FIG. 4 shows a sine curve moisture profile across a 1½ inch thick board that is sandwiched between ⅛ inch thick face sheets constructed of a material with the same moisture diffusion coefficient as the board. For a constant surface EMC and with a constant diffusion coefficient across the board, the theoretical mathematical analysis shows that such profiles approach a sine curve. Experimental data show that this is a reasonably accurate assumption for profiles in many refractory species.

Table 1 shows the degree of protection provided by two designs of the moisture pallet during the course of drying. Using the previous example of two-inch thick white oak and the more stringent R value of 0.1138; the cotangent equation for the sine moisture profile reduces to:

$$M_E = 1.6192M_X - 0.6192M_B$$

Similarly, for the less stringent conditions, where R=0.0796, the cotangent equation gives:

$$M_E = 1.4224M_X - 0.4224M_B$$

Columns (2) and (3) of Table 1 were obtained from the FPL kiln schedule T3,C1. For each of the board average moisture contents ($M_B$) listed in column 2, column (3) gives the board surface moisture content ($M_X$) recommended for the kiln schedule. Each of these pair of values can be used in the above equations to calculate the Null EMC, which is the value of ambient EMC ($M_E$) that will result in a pallet value of $M_X$ equal to the recommended kiln schedule value. The objective is to illustrate the level to which the ambient EMC can fall before the degree of protection provided by the moisture pallet will start to fall below that provided by the recommended kiln schedule.

Table 1

FPL kiln drying schedule T3, C1 for 8/4 white oak (columns (1), (2), and (3)), and the Null or ambient EMC of the drying air that will result in the oak surface moisture content under the thicker pallet facing column (4) and under the thinner pallet facing column (5) having the same value, $M_X$, as recommended for the kiln schedule (column 3)).

| (1) Kiln Schedule Step No. | (2) Board Average M.C. $\overline{M}_B$ (%) | (3) Board Surface M.C. $\overline{M}_X$ (%) | (4) Null EMC for R = 0.1133 (%) | (5) Null EMC for R = 0.0796 (%) |
|---|---|---|---|---|
| | green | 19 | — | — |
| | 50 | 19 | −0.2 | 5.9 |
| 1 | 45 | 19 | 2.9 | 8.0 |
| | 40 | 19 | 6.0* | 10.1 |
| | 40 | 17.5 | 3.6 | 8.0* |
| 2 | 37.5 | 17.5 | 5.1 | 9.1 |
| | 35 | 17.5 | 6.7 | 10.1 |
| | 35 | 15.1 | 2.8 | 6.7 |
| 3 | 32.5 | 15.1 | 4.3 | 7.8 |
| | 30 | 15.1 | 5.9 | 8.8 |
| | 30 | 12.1 | 1.0 | 4.5 |
| 4 | 27.5 | 12.1 | 2.6 | 5.6 |
| | 25 | 12.1 | 4.1 | 6.7 |
| | 25 | 6.8 | −4.5 | −0.9 |
| 5 | 22.5 | 6.8 | −2.9 | 0.2 |
| | 20 | 6.8 | −1.4 | 1.2 |

*Critical point design value

Column (4) shows that as the oak dries from green to 40% average moisture content, the thicker pallet generally offers more protection against surface checking then does the kiln schedule. Insofar as surface checking is concerned, this is the most critical step in drying. The kiln schedule is held at 19% throughout this step. By contrast, even the lowest possible ambient air EMC levels will not result in the surface moisture content of pallet protected oak falling to 19% until the oak is below 50% average moisture content. At 40% average board moisture content, the 19% $M_X$ value will result from a Null EMC of 6% since this was the critical point design value for the pallet.

At the end of the second step, the Null EMC in column (4) rises above its 6% design level to 6.7%. The pallet thickness could be recalculated to meet the 6% requirement at this level; but from a practical standpoint, the deviation is of small importance since the risk of surface checking is generally greater at the 40% moisture level. At the end of step 3, the design EMC level is not quite reached by the 5.9% value for the Null EMC. In steps 4 and 5, the degree of protection is greater than needed and is obtained at the cost of slower drying rates. Thus, the pallet can be designed to provide a specified degree of protection for the critical mid range of 40% average moisture content, and it will provide a beneficial added protection at the higher moisture levels. The most critical stage in the drying of oak is in reducing the initial moisture content, usually around 85–80%, down to an average moisture content of 35–30% without incurring excessive surface checking or splitting. Thus, adequate protection is provided in this critical range. However, below 30% average moisture content the protection provided is greater than needed; but at this point, the lumber is normally transferred to a dry kiln for the completion of drying.

The kiln schedules are changed abruptly at the end of each step simply as a matter of convenience for hand set controls. Since the new setting at the beginning of each step is presumably not too severe for the wood, then the end of the previous step is unnecessarily mild. Thus, there is good reason to design the moisture pallet around the beginning of the second step, rather than at the end of the first step. This was done for the less stringent calculations which resulted in the R=0.0796 value. A more liberal value of 8% EMC was also used. The degree of protection offered by this design is shown in column (5). It provides better protection above 45% than it does at the 40% design point at the beginning of step 2; and at the beginning of each subsequent step, the protection exceeds the design value since all of the Null EMC values are below 8% at the start of the step.

These calculations assume a sine profile with a constant or sustained ambient EMC value. Even greater protection will be provided against the short term daily drops in ambient EMC that are typical of weather patterns. Also, it is clear that while unusually severe drying weather may occasionally result in less protection by the pallet than is provided by the recommended kiln schedule, the degree of protection provided for the pallet stacks will vastly exceed that available to conventional air drying stacks.

The FPL kiln schedules differ with different species of lumber. Thus, if the preceding analysis for white oak is carried out for the schedule recommended for red oak, it will result in R values of 0.0950 for the more stringent value and 0.0550 for the less stringent. The two species do not differ markedly in diffusion coefficient, so the same pallet design could satisfactorily serve both species since the R values do overlap. From a practical standpoint, it is desirable to limit the number of pallet designs to as small a number as possible, consistent with adequate protection and reasonably rapid drying rate. Thus, it is probable that a given design will be used with more than one lumber thickness and also with several different species of wood.

While the above mathematical example assumed that the face sheet diffusion coefficient was the same as the value for the oak, it is unlikely that oak veneers would be used in the face sheet. However, the resistance of the glue line must be added to the veneers to give the total resistance of the face sheet so permeable veneers plus a relatively impermeable glue line can result in diffusion coefficients comparable to the oak values. The face sheet thickness, as well as the veneer species and the glue line, can also be predetermined to reach the desired levels of protection.

Under a given set of drying conditions in which the drying lumber stacks are continously exposed to the drying air, the stack using the pallets will dry slower and thus require more drying time than the stack without pallets.

In many areas of the country, summertime relative humidities can be dangerously low during the day but ineffectively high at night for air drying. By utilizing pallets this cycle can be smoothed out by protecting the refractory species from the severe daytime drying conditions and also allowing drying to continue at night. This can be accomplished by enclosing stacks of pallets and boards in sheds or otherwise protecting them from the night air so that the face sheets will not regain moisture from the damp air but will instead continue to absorb moisture from the wetter boards. During the day, said stacks can be exposed to the air and the moisture in the face sheets can be rapidly evaporated. In this way the face sheets serve as a moisture sink and the increase in drying time resulting from the use of pallets can be substantially diminished.

The use of said stacks makes it feasible to apply both forced air drying and solar heating to the drying of oak and similar refractory species. During the day, the fans can be turned on to circulate the drying air and rapidly evaporate moisture from the face sheets. Solar heating of the drying shed may be used to lower the humidity by raising the temperature of the ambient air. Low humidity levels, which could cause severe surface checking if applied directly to the surface of the oak, can be safely used if the oak surfaces are protected by the face sheets. The higher temperatures will also speed moisture diffusion through the wood. During the night, the fans can be turned off but the dry face sheets will continue to absorb moisture from the wetter oak. This moisture can then be evaporated the following day. The only operating energy consumption is that required for the daytime operation of the fans.

The length of time the fans are operated each day could be determined by monitoring the average moisture content of the drying charge as well as the temperature and relative humidity of the ambient air. The EMC at the oak surface could thus be safely controlled by intermittent evaporation of moisture from the face sheets which are continuously absorbing moisture from the oak.

The use of said stacks will also make feasible the air drying of small random lengths and widths of lumber such as may be generated from gang sawing of the so-called "green junk" hardwoods that occur as small trees in understory species on pine and other sites. Close spacing of the small spacing means will be necessary to provide support for the face sheets of the pallets but this close spacing will also make it possible to include lengths of green lumber as small as 2 or 3 feet.

The technique using said stacks will also reduce end checking since the air velocity across the interior ends will be minimal.

What is claimed is:

1. A stack of boards of refractory hardwoods and pallets consisting of a plurality of single layers of boards of refractory hardwoods alternating with pallets, each integral pallet consisting of two facing sheets of plywood with spacing means for spacing said facing sheets of plywood apart a predetermined distance.

2. A method for air drying boards of refractory hardwoods consisting of:

(a) forming a stack by alternating single layers of boards of refractory hardwoods and pallets, each integral pallet consisting of two facing sheets of plywood with spacing means for spacing said facing sheets of plywood a predetermined distance, and (b) contacting air with the surfaces of said facing sheets of plywood.

3. Stack of boards of refractory hardwoods and pallets of claim 1 or claim 2, wherein said facing sheets of plywood have a water diffusion coefficient identical to the water diffusion coefficient of the refractory hardwood being dried, the thickness of said identical facing sheets being calculated from the equations, $$\frac{\bar{M}_B - M_E}{M_X - M_E} \frac{(\pi)}{2} = (2R + 1)\,\mathrm{Cot}[\pi R/(2R + 1)]$$

and $$X_I = RW \text{ wherein}$$

$M_B$ is the board average moisture content, $M_X$ is the board surface moisture content, which is also the moisture content at the interface between the board and the facing, $M_E$ is the equilibrium moisture content for the most severe ambient drying atmosphere, R is the ratio of facing sheet thickness to refractory hardwood thickness, W is the thickness of the refractory hardwood being dried, and $X_I$ is the identical facing sheet thickness.

4. Stack of boards of refractory hardwoods and pallets of claim 1 or claim 2, wherein said facing sheets of plywood have a moisture diffusion coefficient different from the moisture diffusion coefficient of the refractory hardwood being dried, the actual thickness of said facing sheets being calculated by the equation, $$X_E = X_I\left(\frac{D_E}{D_I}\right)$$

wherein $X_E$ is the actual facing sheet thickness, $X_I$ is the identical facing sheet thickness, $D_E$ is the diffusion coefficient of the facing sheet, and $D_I$ is the diffusion coefficient of the refractory hardwood.

* * * * *